US008823286B2

(12) United States Patent
Sasai et al.

(10) Patent No.: US 8,823,286 B2
(45) Date of Patent: Sep. 2, 2014

(54) DIMMING DEVICE AND LIGHTING SYSTEM

(75) Inventors: Toshihiko Sasai, Yokosuka (JP); Hirokazu Otake, Yokosuka (JP); Katsuyuki Kobayashi, Yokosuka (JP); Masayuki Tanaka, Yokosuka (JP)

(73) Assignee: Toshiba Lighting & Technology Corporation, Kanagawa (JP)

( * ) Notice: Subject to any disclaimer, the term of this patent is extended or adjusted under 35 U.S.C. 154(b) by 163 days.

(21) Appl. No.: 13/614,232

(22) Filed: Sep. 13, 2012

(65) Prior Publication Data

US 2013/0187563 A1 Jul. 25, 2013

(30) Foreign Application Priority Data

Jan. 19, 2012 (JP) ..... 2012-009392

(51) Int. Cl.
*H05B 37/02* (2006.01)

(52) U.S. Cl.
USPC ..... 315/307; 315/224; 315/209 R

(58) Field of Classification Search
USPC ..... 315/307, 287, 127, 224, 186, 209 R, 297
See application file for complete search history.

(56) References Cited

U.S. PATENT DOCUMENTS

2010/0090607 A1 4/2010 Vos
2012/0194091 A1* 8/2012 Darshan ..... 315/209 R

FOREIGN PATENT DOCUMENTS

EP 2302980 A2 3/2011
JP 2011238353 A 11/2011
WO 2008029108 A1 3/2008

OTHER PUBLICATIONS

European Search Report; EP Application No. 12184614.1; Mailed Dec. 12, 2012.

* cited by examiner

*Primary Examiner* — Daniel D Chang
(74) *Attorney, Agent, or Firm* — Patterson & Sheridan LLP

(57) ABSTRACT

According to one embodiment, a control section receives supply of control power from a control power supply section through a capacitive element and divides, a period of each half cycle of an alternating-current voltage into a first section, a second section, and a third section. In the first section, the control section subjects a switch section to conduction control to supply electric power to a load and stops a converting action of the control power supply section. In the second section, the control section subjects the switch section to non-conduction control to interrupt the power supply to the load and stops the converting action of the control power supply section. In the third section, the control section subjects the switch section to the non-conduction control to interrupt the power supply to the load and causes the converting action of the control power supply to operate.

10 Claims, 8 Drawing Sheets

DIMMING DEVICE AND LIGHTING SYSTEM

INCORPORATION BY REFERENCE

The present invention claims priority under 35 U.S.C. §119 to Japanese Patent Application No. 2012-009392 filed on Jan. 19, 2012. The content of the application is incorporated herein by reference in their entirety.

FIELD

Embodiments described herein relate generally to a two-wire dimming device and a lighting system including the dimming device.

BACKGROUND

In the past, a two-wire dimming device connected to an alternating-current power supply in series to a load such as an incandescent lamp to subject the load to dimming control adopts a phase control system for controlling conduction and non-conduction to the load halfway in a period of each half cycle of an alternating-current voltage according to a set dimming level using a switch section including a triac and a switching element and a rectifying element connected in series in opposite directions. The dimming device includes a control section configured to control the switch section and a control power supply section connected to the alternating-current power supply in parallel to the switch section and configured to convert alternating-current power into predetermined control power and supply the control power to the control section.

A load including a discharge lamp or a semiconductor light-emitting element such as an LED or an organic EL as a light source includes a power supply circuit in order to improve lighting characteristics and realize highly-efficient and stable lighting. A dimming function is added to the power supply circuit, whereby the load including the power supply circuit and the two-wire dimming device can be connected to the alternating-current power supply in series and used. The power supply circuit including the dimming function acquires dimming information from a phase of an alternating-current voltage controlled by the dimming device and subjects the light source to dimming control.

However, when the load including the power supply circuit and the two-wire dimming device are connected to the alternating-current power supply in series and used, if a control power supply section on the dimming device side is affected by the power supply circuit on the load side, it is likely that the phase of the alternating-current voltage controlled by the dimming device changes, accurate dimming information may not be able to be acquired from the phase of the alternating-current voltage in the power supply circuit on the load side, and the power supply circuit on the load side malfunctions.

There is provided a dimming device and a lighting system that can normally dim a load even if the load includes a power supply circuit.

DETAILED DESCRIPTION

In general, according to one embodiment, a dimming device includes a switch section, a synchronization-signal generating section, a control power supply section, and a control section. The switch section is connected to an alternating-current power supply in series to a load and configured to phase-control an alternating-current voltage supplied to the load. The synchronization-signal generating section is configured to generate a synchronization signal synchronized with an alternating-current voltage waveform of the alternating-current power supply. The control power supply section is connected to the switch section in parallel and configured to convert alternating-current power into predetermined control power and enable control of operation and stop of the converting action and include a capacitive element that accumulates the control power. The control section is configured to receive supply of the control power from the control power supply section through the capacitive element and divide, on the basis of the synchronization signal generated by the synchronization-signal generating section, a period of each half cycle of the alternating-current voltage into a first section, a second section, and a third section. In the first section, the control section subjects the switch section to conduction control to supply electric power to the load and subjects the converting action of the control power supply section to stop control. In the second section, the control section subjects the switch section to non-conduction control to interrupt the power supply to the load and subjects the converting action of the control power supply section to stop control. In the third section, the control section subjects the switch section to the non-conduction control to interrupt the power supply to the load and subjects the converting action of the control power supply to operation control.

With this configuration, in the first section, the control section subjects the switch section to the conduction control to supply electric power to the load and subjects the converting action of the control power supply section to the stop control. In the second section, the control section subjects the switch section to the non-conduction control to interrupt the power supply to the load and subjects the converting action of the control power supply section to the stop control to transmit dimming information to the load side. In the third section, the control section subjects the switch section to the non-conduction control to interrupt the power supply to the load and subjects the converting action of the control power supply section to the operation control to supply electric power to the control section and enable the control section to acquire the synchronization signal. Therefore, it may be possible to normally subject the load to the dimming control even if the load includes the power supply circuit.

A first embodiment is explained with reference to FIGS. 1 to 9.

Figure 5:
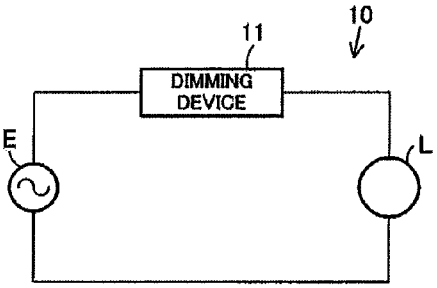
FIG. 5 is a block diagram of a lighting system including the dimming device.

A lighting system 10 is shown in FIG. 5. In the lighting system 10, a load (a lighting load) L and a two-wire dimming device 11 are connected to an alternating-current power supply E in series.

Figure 1:
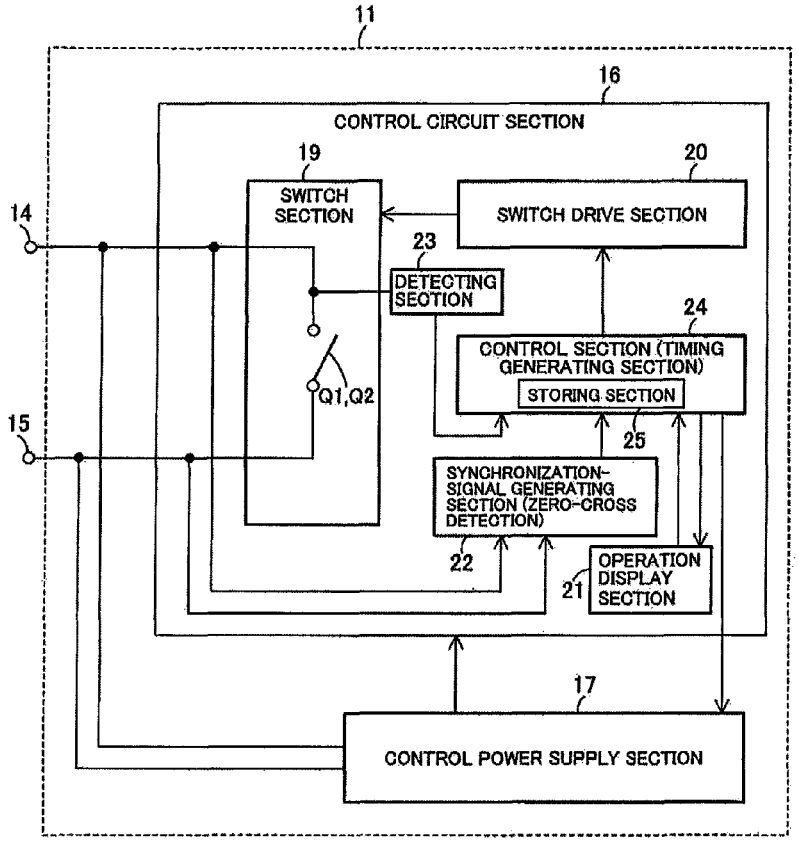
FIG. 1 is a block diagram of a dimming device according to a first embodiment.

FIG. 1 is a block diagram of the dimming device 11. The dimming device 11 includes terminals 14 and 15 respectively connected to the alternating-current power supply E and the load L. A control circuit section 16 and a control power supply section 17 that supplies control power to the control circuit section 16 are connected in parallel between the terminals 14 and 15.

The control circuit section 16 includes a switch section that phase-controls an alternating-current voltage supplied to the load L, a switch drive section 20 that drives the switch section 19, an operation display section 21 including an operation function for adjustment and setting of dimming and a display function, a synchronization-signal generating section 22 that generates a synchronization signal synchronized with an alternating-current voltage waveform of the alternating-current power supply E, a detecting section 23 that detects an electric current flowing to the load L, and a control section 24 that controls the switch drive section 20 and the control power supply section 17 on the basis of signals from the operation display section 21, the synchronization-signal generating section 22, and the detecting section 23. The control section 24 includes a storing section 25 that stores, for example, setting information of a dimming lower limit value.

Figure 2:
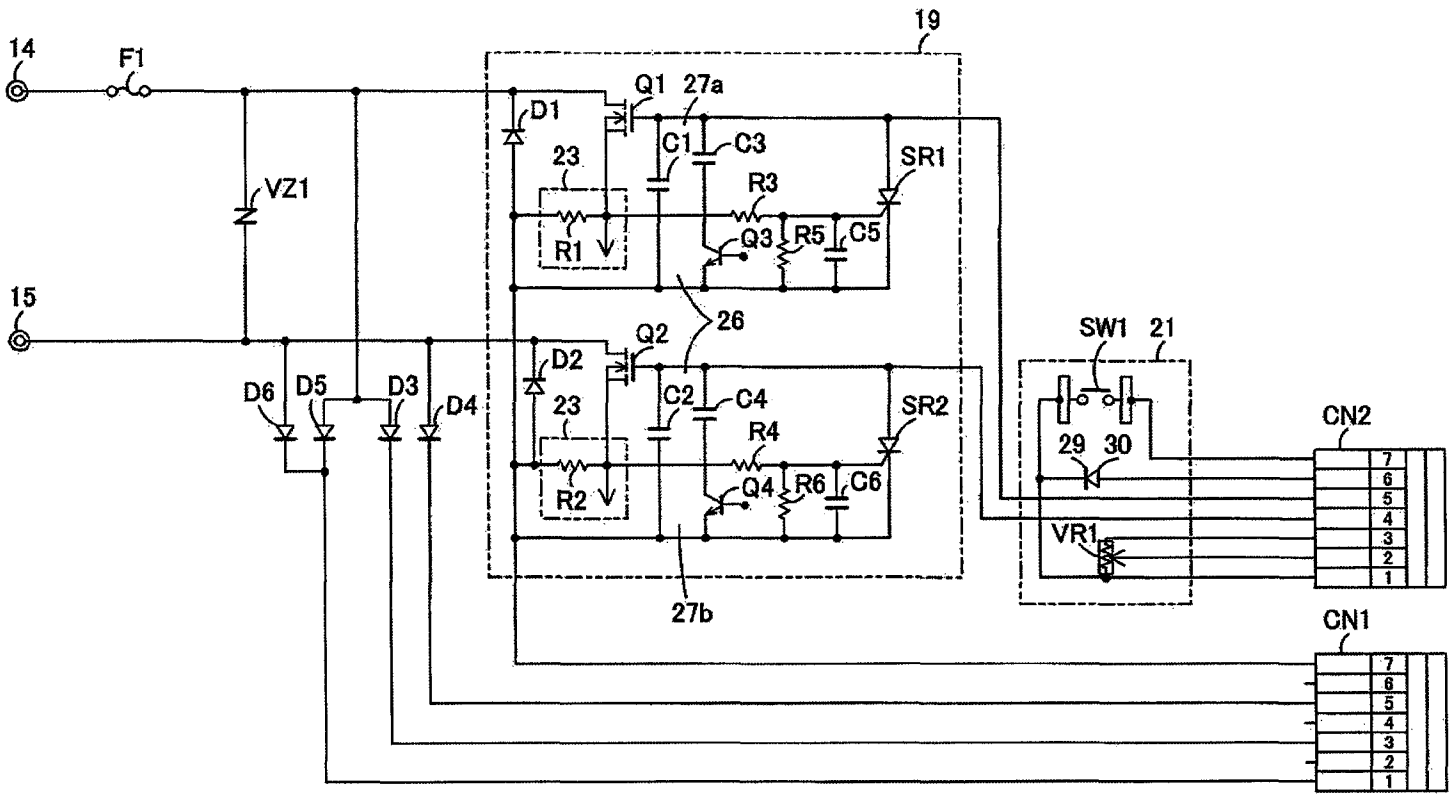
FIG. 2 is a circuit diagram of the dimming device.
Figure 3:
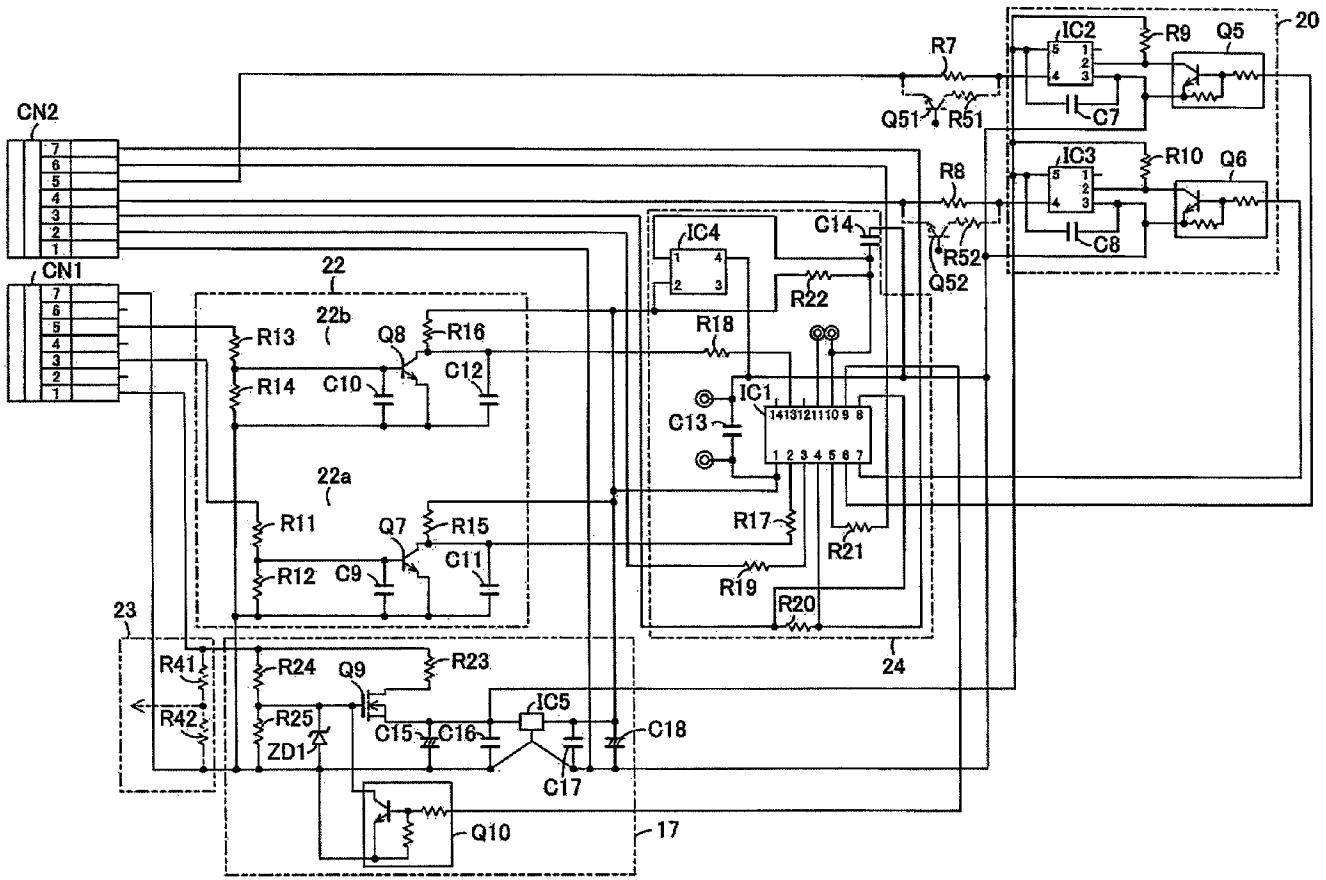
FIG. 3 is a circuit diagram of the dimming device.

FIGS. 2 and 3 are circuit diagrams of the dimming device 11. A circuit shown in FIG. 2 and a circuit shown in FIG. 3 are separately shown. However, the circuit shown in FIG. 2 and the circuit shown in FIG. 3 are electrically connected by a connector CN1 and a connector CN2.

A fuse F1 and a varistor VZ1 are connected between the terminals 14 and 15. The control circuit section 16 and the control power supply section 17 are connected to both ends of the varistor VZ1.

In the switch section 19 of the control circuit section 16, a cathode of a diode D1 is connected to one end of the varistor VZ1 connected to the fuse F1 and a cathode of a diode D2 is connected to the other end of the varistor VZ1. Anodes of the diodes D1 and D2 are connected to each other and connected to a ground side line of the control power supply section 17 via the connector CN1. Drains of field effect transistors Q1 and Q2 functioning as switching elements are connected to the cathodes of the diodes D1 and D2. Sources of the field effect transistors Q1 and Q2 are connected to the anodes of the diodes D1 and D2 via resistors R1 and R2.

Capacitors C1 and C2 for bias, a series circuit of collectors and emitters of transistors Q3 and Q4 and capacitors C3 and C4, and anodes and cathodes of thyristors SR1 and SR2 are connected between gates of the field effect transistors Q1 and Q2 and the anodes of the diodes D1 and D2 in parallel. Bases of the transistors Q3 and Q4 are connected to a microcomputer IC1 of the control section 24. The transistors Q3 and Q4 are turned on and off according to "H" and "L" signals from the microcomputer IC1.

Gates of the thyristors SR1 and SR2 are connected to the sources of the field effect transistors Q1 and Q2 via resistors R3 and R4. Resistors R5 and R6 and capacitors C5 and C6 are connected between the gates and the cathodes of the thyristors SR1 and SR2. The thyristors SR1 and SR2, the resistors R1 to R6, and the capacitors C5 and C6 configure an over-current protection circuit that turns off the field effect transistors Q1 and Q2 when an over current flows to a current circuit including the field effect transistors Q1 and Q2.

The gates of the field effect transistors Q1 and Q2 are connected to the switch drive section 20 via the connector CN2 and resistors R7 and R8. The field effect transistors Q1 and Q2 are turned on and off according to "H" and "L" signals from the switching drive section 20. The capacitors C1 and C2, the transistors Q3 and Q4, the capacitors C3 and C4, and the resistors R7 and R8 configure time-constant circuits 27*a* and 27*b* functioning as inclination control means 26 that can set an inclination angle at a falling edge of an alternating-current voltage during OFF control (during interruption control) of the field effect transistors Q1 and Q2 and change the inclination angle according to control by the microcomputer IC1 of the control section 24. In the time-constant circuits 27*a* and 27*b*, as indicated by an alternate long and two short dashes line in FIG. 3, emitters and collectors of transistors Q51 and Q52 and resistors R51 and R52 may be connected in parallel to the resistors R7 and R8 instead of the transistors Q3 and Q4 and the capacitors C3 and C4. Bases of the transistors Q51 and Q52 may be connected to the microcomputer IC1 of the control section 24.

The switch drive section 20 includes integrated circuits IC2 and IC3 for buffer that supply control signals for turning on and off the field effect transistors Q1 and Q2. A control power supply line for supplying control power of 10 to 11 V from a control power supply section 17 is connected to ports 5 of the integrated circuits 102 and 103. The control power supply line is connected to ports 2 of the integrated circuits IC2 and IC3 via resistors R9 and R10 and connected to ports 3 of the integrated circuits IC2 and IC3 via capacitors C7 and C8. Collectors of transistors Q5 and Q6 are connected between the resistors R9 and R10 and the ports 2 of the integrated circuits 102 and IC3. Emitters of the transistors Q5 and Q6 are connected to the ground side line of the control power supply section 17. Bases of the transistors Q5 and Q6 are connected to the microcomputer IC1 of the control section 24. The transistors Q5 and Q6 are turned on and off according to "H" and "L" signals from the microcomputer IC1. According to the turn-on and turn-off of the transistors Q5 and Q6, the "H" and "L" signals are output to the field effect transistors Q1 and Q2 from ports 4 of the integrated circuits IC2 and 103.

The operation display section 21 includes a variable resistor VR1 for changing dimming, an LED 30 functioning as a display section 29 that lights during off of the load L and performs lighting display in a predetermined display form during setting, and a push button switch SW1 for operating setting and release of a dimming lower limit value. The variable resistor VR1, the LED 30, and the push button switch SW1 are respectively connected between ports of the microcomputer IC1 of the control section 24 and the ground side line of the control power supply section 17.

The synchronization-signal generating section 22 includes two zero-cross detecting sections 22*a* and 22*b* for a positive electrode and a negative electrode. Anodes of diodes D3 and D4 are connected to both the ends of the varistor VZ1. Voltage dividing circuits of resistors R11 and R12 and voltage dividing circuits of resistors R13 and R14 are connected between cathodes of the diodes D3 and D4 and the ground side line of the control power supply section 17. Bases of transistors Q7 and Q8 are connected to an intermediate point of the resistors R11 and R12 and an intermediate point of the resistors R13 and R14. Bases and emitters of the transistors Q7 and Q8 are connected to the resistor R12 and the resistor R14 in parallel. Capacitors C9 and 010 are connected to the resistor R12 and the resistor R14 in parallel. Collectors of the transistors Q7 and Q8 are connected to a 3.3V control power supply line of the control power supply section 17 via resistors R15 and R16. Capacitors C11 and C12 are connected between the collectors and the emitters of the transistors Q7 and Q8. Sections between the collectors of the transistors Q7 and Q8 and the capacitors C11 and C12 are connected to the microcomputer IC1 of the control section 24.

When the terminal 14 side shifts to a period of a positive half cycle of the alternating-current voltage, the transistor Q7 is turned on and the transistor Q8 is turned off. When the terminal 15 side shifts to a period of a negative half cycle of the alternating-current voltage, the transistor Q8 is turned on and the transistor Q7 is turned off. According to the turn-on and turn-off of the transistors Q7 and Q8, a phase and a zero-cross of the alternating-current voltage are detected.

In a detecting section 23, sections between sources of the field effect transistors Q1 and Q2 and the resistors R1 and R2 of the switch section 19 are connected to a port 12 of the microcomputer IC1 of the control section 24. The detecting section 23 detects a load current flowing to the load L via the resistors R1 and R2. The detecting section 23 may detect a voltage instead of an electric current. As indicated by an alternate long and short two dashes line in FIG. 3, voltage dividing circuits of resistors R41 and R42 are connected between a positive electrode side line and the ground side line of the control power supply section 17. A section between the resistors R41 and R42 is connected to the port 12 of the microcomputer IC1 of the control section 24.

The control section 24 is a timing generating section. The control section 24 includes the microcomputer CI1. 3.3V control power is supplied to a port 1 of the microcomputer IC1 from the control power supply section 17. A capacitor C13 is connected between the port 1 and a port 14. The collectors of the transistors Q7 and Q8 of the synchronization-signal generating section 22 are connected to ports 2 and 13 via resistors R17 and R18. An intermediate contact of the variable resistor VR1 of the operation display section 21 is connected to a port 3 via a resistor R19. An end contact of the variable resistor VR1 is connected to a port 8. The push button switch SW1 is connected to a port 4. A resistor R20 is connected between the port 4 and the port 8. The LED 30 is connected to a port 5 via a resistor R21. The bases of the transistors Q5 and Q6 of the switch drive section 20 are connected to ports 6 and 7.

The control section 24 further includes an integrated circuit IC4 for reset. The 3.3V control power is supplied to a port 2 of the integrated circuit IC4 from the control power supply section 17. A port 1 is connected to a port 10 of the microcomputer IC1. A resistor R22 is connected between the port 1 and the port 2. A capacitor C14 is connected between a section between the port 1 and the resistor R22 and the ground side line of the control power supply section 17.

The microcomputer IC1 has a function of controlling the switch drive section 20 and the control power supply section 17. The microcomputer IC1 has a timer function and also has a function of a sleep mode for halting functions other than necessary minimum functions including the timer function to suppress power consumption as much as possible.

The positive electrode side line connected via the diodes D5 and D6, the anodes of which are connected to both the ends of the varistor VZ1, and the ground side line connected to both the ends of the varistor VZ1 via the diodes D1 and D2 are connected to the control power supply section 17. A drain of a field effect transistor Q9 used as a control element of a dropper circuit is connected to the positive electrode side line via a resistor R23. A source of the field effect transistor Q9 is connected to the ground side line via an electrolytic capacitor C15. Resistors R24 and R25 of voltage dividing circuits are connected between the positive electrode side line and the ground side line. An intermediate point of the resistors R24 and R25 is connected to a gate of the field effect transistor Q9. A Zener diode ZD1, a cathode of which is connected between the intermediate point of the resistors R24 and R25 and the gate of the field effect transistor Q9, is connected to the resistor R25 in parallel. Charges are accumulated in the electrolytic capacitor C15 during the operation of the field effect transistor Q9. 10 to 11V control power is supplied to the switch drive section 20 via the electrolytic capacitor C15.

A capacitor C16, a regulator 105 that converts a voltage to a 3.3V voltage, a capacitor C17, and an electrolytic capacitor C18 functioning as a capacitive element are connected to both ends of the electrolytic capacitor C15 in parallel. Charges are accumulated in the electrolytic capacitor C18 during the operation of the field effect transistor Q9. 3.3V control power is supplied to the control section 24 via the electrolytic capacitor C18.

A collector and an emitter of a transistor Q10 are connected between a base of the field effect transistor Q9 and the ground side line. A base of the transistor Q10 is connected to a port 9 of the microcomputer IC1 of the control section 24. The transistor Q10 is turned on and off according to "H" and "L" signals from the microcomputer IC1. The field effect transistor Q9 is stopped when the transistor Q10 is on. The field effect transistor Q9 is actuated when the transistor Q10 is off.

Figure 4:
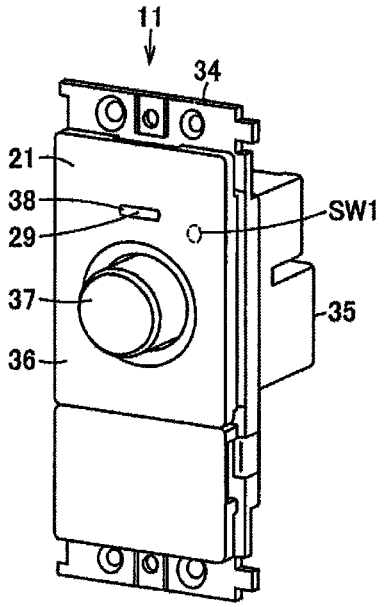
FIG. 4 is a perspective view of the dimming device.

FIG. 4 is a perspective view of the dimming device 11. The dimming device 11 includes a support 34 for attaching a wiring box. A main body 35 in which the control circuit section 16, the control power supply section 17, and the like are housed is attached to the support 34. A cover 36 is detachably attached to the front surface of the main body 35. A dimming operation section 37 for operating the variable resistor VR1 is projected on the cover 36. A display window 38 (the display section 29) that transmits light of the LED 30 is formed on the cover 36. The push button switch SW1 operable by removing the cover 36 is arranged on the front surface of the main body 35.

Figure 6:
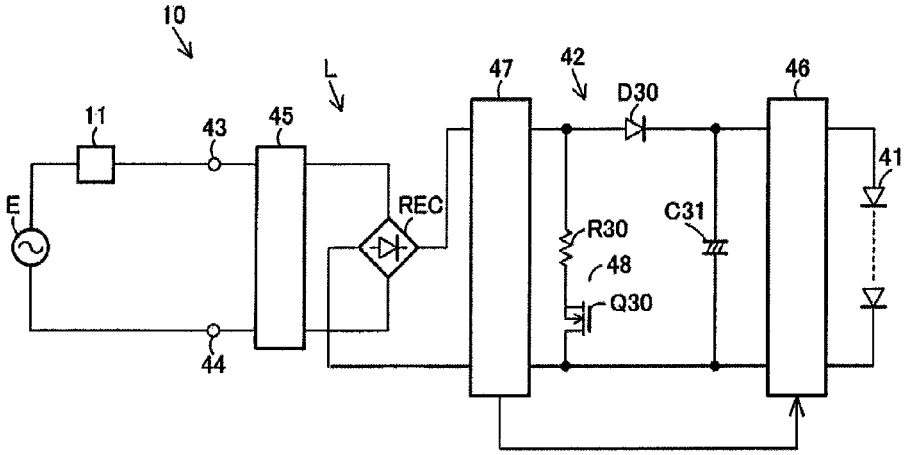
FIG. 6 is a circuit diagram of the lighting system.

FIG. 6 is a circuit diagram of the illuminating system 10.

The load L includes a plurality of LED elements 41, which are semiconductor light-emitting elements functioning as light sources, and a power supply circuit 42 that turns on the LED elements 41.

The power supply circuit 42 includes terminals 43 and 44 connected to the alternating-current power supply E in series to the dimming device 11. A filter circuit 45 including a capacitor and a choke coil is connected between the terminals 43 and 44. A pair of input terminals of a full-wave rectifier REC are connected to both ends of the filter circuit 45. A smoothing circuit including a diode D30 and an electrolytic capacitor C31 is connected to a pair of output terminals of the full-wave rectifier REC. An input section of a converter 46 is connected to both ends of the electrolytic capacitor C31. The LED elements 41 are connected to an output section of the converter 46. A phase detecting circuit 47 that detects a phase of a voltage phase-controlled by the dimming device 11 is connected between the pair of output terminals of the full-wave rectifier REC and the smoothing circuit including the diode D30 and the electrolytic capacitor C31. Phase information detected by the phase detecting circuit 47 is input to the converter 46.

The converter 46 includes, for example, a falling-voltage chopper. The converter 46 subjects a switching element of the falling-voltage chopper to ON and OFF control using a not-shown lighting control circuit and controls on-duty of the switching element according to phase information from the phase detecting circuit 47 to thereby convert a rectified and smoothed direct-current voltage into predetermined output voltage for turning on the LED elements 41.

A bleeder circuit 48 including a resistor R30 and a field effect transistor Q30 is connected in parallel to the phase detecting circuit 47 between the pair of output terminals of the full-wave rectifier REC and the smoothing circuit including the diode D30 and the electrolytic capacitor C31. The bleeder circuit 48 subjects the field effect transistor Q30 to ON control according to a dimming level using a not-shown lighting control circuit and extracts a bleeder current determined by the resistor R30.

Since the power supply circuit 42 includes the bleeder circuit 48, even in a period in which an electric current does not flow into the converter 46 when the dimming level is set near the dimming lower limit, the bleeder current flows via the bleeder circuit 48. Consequently, it is possible to monitor a waveform of a power supply voltage and detect the zero-cross in the dimming device 11.

The operation of the dimming device 11 is explained.

The control power supply section 17 of the dimming device 11 converts alternating-current power E into predetermined control power and supplies the converted control power to the microcomputer IC1 of the control section 24 and the integrated circuits IC2 and IC3 of the switch drive section 20.

The microcomputer IC1 acquires information concerning a phase and a zero cross of an alternating-current voltage detected by the synchronization-signal generating section 22, dimming level information set by the variable resistor VR1 in association with the operation of the dimming operation section 37, and information concerning a value of an electric current flowing to the load L detected by the detecting section 23.

The microcomputer IC1 outputs "H" and "L" signals from a port 6 and a port 7 in synchronization with the phase of the alternating-current voltage and subjects the transistors Q5 and Q6 to the ON and OFF control. The microcomputer IC1 outputs the "H" and "L" signals from the ports 4 of the integrated circuits 102 and 103 according to the turn-on and turn-off of the transistors Q5 and Q6 and subjects the field effect transistors Q1 and Q2 of the switch section 19 to the ON and OFF control.

According to the control by the microcomputer 101, the field effect transistor Q1 is turned on and off in a period of a positive half cycle of the alternating-current voltage and the field effect transistor Q2 is turned on and off in a period of a negative half cycle of the alternating-current voltage. The synchronization-signal generating section 22 includes the two zero-cross detecting sections 22*a* and 22*b* for the positive electrode and the negative electrode and can detect positive and negative phases together with the zero-cross of the alternating-current voltage. Therefore, the microcomputer IC1 can control the two field effect transistors Q1 and Q2 according to the positive and negative phases of the alternating-current voltage.

Figure 8:
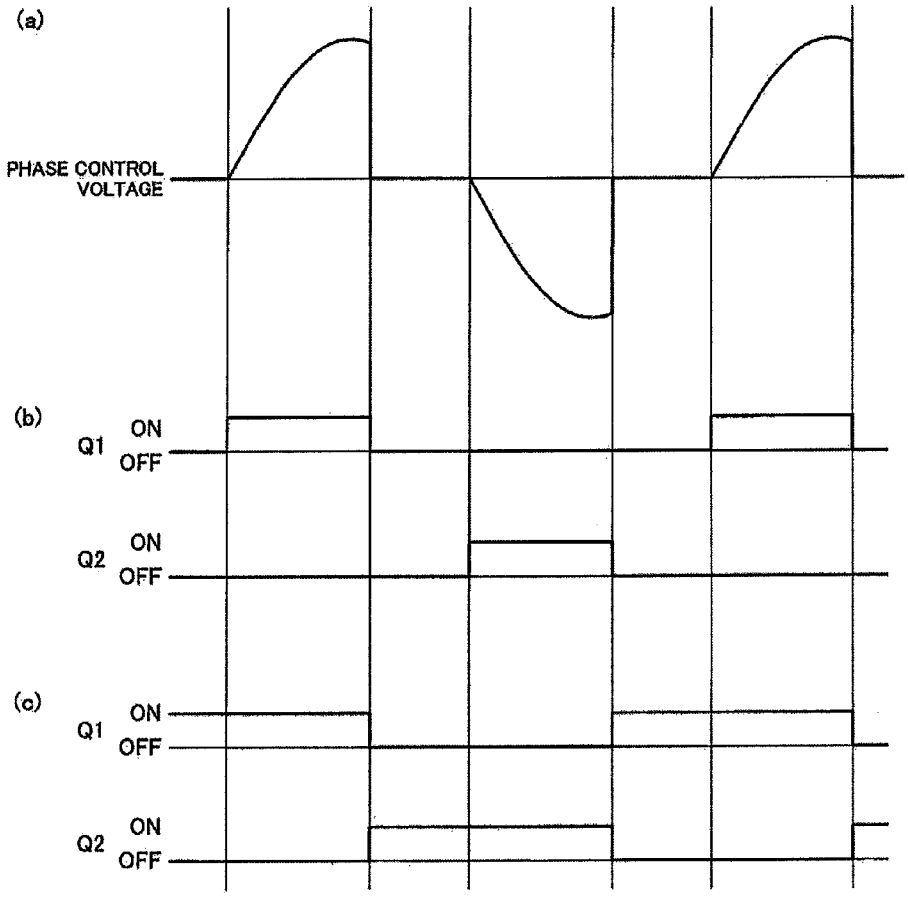
FIGS. 8(*a*) to 8(*c*) are diagrams for explaining phase control by the dimming device.

The ON and OFF control of the field effect transistor Q2 by the microcomputer IC1 includes a first control method (see FIG. 8(*b*)) and a second control method (see FIG. 8(*c*)), either of which may be used. In FIGS. 8(*a*) to 8(*c*), FIG. 8(*a*) is a waveform chart of a phase-controlled waveform, FIG. 8(*b*) is a timing chart of on and off of the field effect transistor Q1 by the first control method, and FIG. (c) is a timing chart of on and off of the field effect transistor Q1 by the second control method.

In the first control method, when the terminal 14 side shifts to the period of the positive half cycle of the alternating-current voltage, the microcomputer IC1 switches a signal from the port 4 of the integrated circuit IC2 from "L" to "H" and subjects the field effect transistor Q1 to the ON control. The alternating-current power E flows to the terminal 15 through a route of the fuse F1, the field effect transistor Q1, the resistor R1, and the diode D2. An electric current flows to the load L. The microcomputer IC1 switches the signal from the port 4 of the integrated circuit 102 from "H" to "L" after a predetermined time corresponding to a dimming level from the zero-cross when the terminal 14 side shifts to the period of the positive half cycle of the alternating-current voltage. The microcomputer IC1 subjects the field effect transistor Q1 to OFF control.

Similarly, when the terminal 15 side shifts to the period of the positive half cycle of the alternating-current voltage, the microcomputer IC1 switches the signal from the port 4 of the integrated circuit IC3 from "L" to "H" and subjects the alternating-current power E flows to the terminal 14 through a route of the field effect transistor Q2, the resistor R2, the diode D1, and the fuse F1. An electric current flows to the load L. The microcomputer 101 switches the signal from the port 4 of the integrated circuit 103 from "H" to "L" after a predetermined time corresponding to a dimming level from the zero-cross when the terminal 15 side shifts to the period of the positive half cycle of the alternating-current voltage. The microcomputer 101 subjects the field effect transistor Q2 to the OFF control.

In the second control method, when the terminal 14 side shifts to the period of the positive half cycle of the alternating-current voltage, the field effect transistor Q1 is on. Therefore, when the terminal 14 side shifts to the period of the positive half cycle of the alternating-current voltage, the alternating-current power E flows to the terminal 15 through a route of the fuse F1, the field effect transistor Q1, the resistor R1, and the diode D2. An electric current flows to the load L. The microcomputer IC1 switches the signal from the port 4 of the integrated circuit 102 from "H" to "L" after a predetermined time corresponding to a dimming level from the zero-cross when the terminal 14 side shifts to the period of the positive half cycle of the alternating-current voltage. The microcomputer IC1 subjects the field effect transistor Q1 to the OFF control. At the same time, the microcomputer IC1 switches the signal from the port 4 of the integrated circuit IC3 from "L" to "H" and subjects the field effect transistor Q2 to the ON control. Even if the field effect transistor Q2 is turned on, when the terminal 14 side is in the period of the positive half cycle of the alternating-current voltage, an electric current does not flow because polarity is reversed.

Similarly, when the terminal 15 side shifts to the period of the positive half cycle of the alternating-current voltage, the field effect transistor Q2 is on. Therefore, when the terminal 15 side shifts to the period of the positive half cycle of the alternating-current voltage, the alternating-current power E flows to the terminal 14 through a route of the field effect transistor Q2, the resistor R2, the diode D1, and the fuse F1. An electric current flows to the load L. The microcomputer IC1 switches the signal from the port 4 of the integrated circuit IC3 from "H" to "L" after a predetermined time corresponding to a dimming level from the zero-cross when the terminal 15 side shifts to the period of the positive half cycle of the alternating-current voltage and subjects the field effect transistor Q2 to the OFF control. At the same time, the microcomputer IC1 switches the signal from the port 4 of the integrated circuit IC2 from "L" to "H" and subjects the field effect transistor Q1 to the ON control. Even if the field effect transistor Q1 is turned on, when the terminal 15 side is in the period of the positive half cycle of the alternating-current voltage, an electric current does not flow because polarity is reversed.

In the second control method, since the field effect transistors Q1 and Q2 are on at the point of the zero-cross, the rise of the voltage from the zero-cross can be smoothed.

Figure 9:
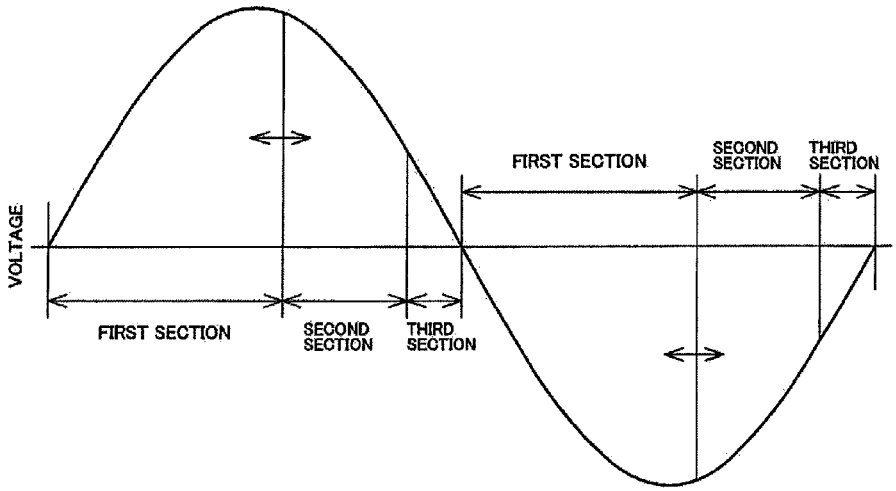
FIG. 9 is a waveform chart of waveform of a voltage phase-controlled by the dimming device.

As explained above, the microcomputer 101 performs, according to the dimming level set in the dimming operation section 37, so-called opposite phase control (back cut phase control) for interrupting conduction to the load L during a period of each half cycle of the alternating-current voltage (see FIG. 9).

Since the switch section 19 is configured to perform phase control at every half cycle using the two field effect transistors Q1 and Q2, the switch section 19 can reduce a power loss. In this case, the microcomputer 101 that controls the two field effect transistors Q1 and Q2 needs to grasp positive and negative phases together with the zero-cross of the alternating-current voltage. Therefore, the synchronization-signal generating section 22 includes the two zero-cross detecting sections 22*a* and 22*b* for the positive electrode and the negative electrode to make it possible to detect the positive and negative phases together with the zero-cross of the alternating-current voltage. Consequently, the microcomputer IC1 can acquire information concerning the positive and negative phases together with the zero-cross of the alternating-current voltage and control the two field effect transistors Q1 and Q2 according to the positive and negative phases of the alternating-current voltage.

The alternating-current voltage phase-controlled by the dimming device 11 is supplied to the power supply circuit 42 of the load L. In the power supply circuit 42, the lighting control circuit acquires dimming information from a waveform of the alternating-current voltage phase-controlled by the dimming device 11 and controls the converter 46 to dim and light the LED elements 41.

In the power supply circuit 42, the alternating-current voltage is rectified by the full-wave rectifier REC, smoothed by the electrolytic capacitor C31, and supplied to the converter 46.

Figure 7:
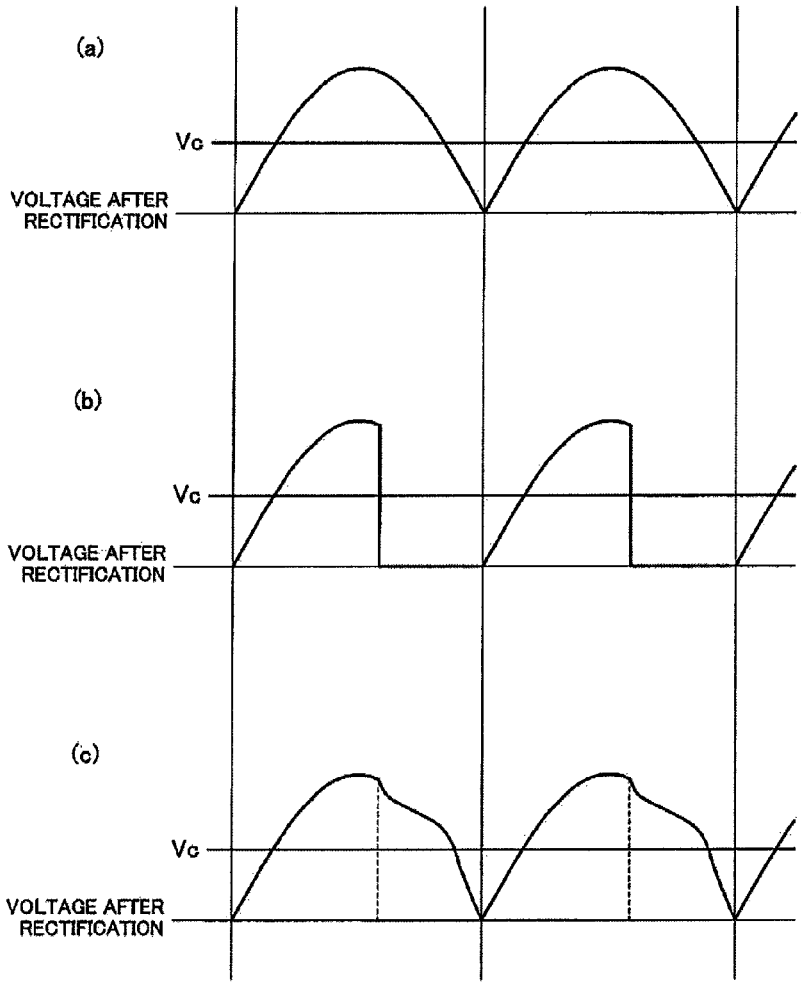
FIGS. 7(*a*) to 7(*c*) are waveform charts of waveforms obtained after an alternating-current voltage phase-controlled by the dimming device is rectified by a load.

FIGS. 7(*a*) to 7(*c*) are waveform charts of waveforms obtained after the alternating-voltage phase-controlled by the dimming device 11 is rectified by the power supply circuit 42. A waveform after the rectification equivalent to a full-light dimming level is shown in FIG. 7(*a*). A waveform after the rectification phase-controlled to a predetermined dimming level is shown in FIG. 7(*b*). After the rectification, the alternating-current voltage is smoothed to a predetermined smoothed voltage Vc by the electrolytic capacitor C31 of the power supply circuit 42. In a section of a voltage lower than the smoothed voltage Vc, an electric current does not flow into the converter 46 and impedance is extremely large.

Since the power supply circuit 42 includes the bleeder circuit 48, even in a period in which an electric current does not flow into the converter 46, the power supply circuit 42 feeds a bleeder current from the bleeder circuit 48. Consequently, in the dimming device 11, it is possible to monitor a waveform of the power supply voltage and detect the zero-cross.

When the power supply circuit 42 includes the bleeder circuit 48, a phenomenon occurs in which an electric current flows to a power supply line via the control power supply section 17, which is converting the alternating-current power E into the control power, a voltage depending on a divided voltage of the impedance of the control power supply section 17 and the impedance of the bleeder circuit 48 affects a voltage phase-controlled by the dimming device 11, and a target phase waveform may not be able to be obtained.

Specifically, a waveform after the rectification phase-controlled to a target dimming level is a waveform in which the alternating-current voltage drops to zero during the period of each half cycle of the alternating-current voltage shown in FIG. 7(*b*). However, because of the influence of the electric current flowing to the power supply line from the control power supply section 17, which is converting the alternating-current power E to the control power, as shown in FIG. 7(*c*), the alternating-current voltage does not drop to zero during the period of each half cycle of the alternating-current voltage and a voltage is continuously generated until the last of the period of each half cycle.

In the power supply circuit 42, since the dimming information is acquired from the waveform in which the voltage drops as shown in FIG. 7(*b*), in the waveform shown in FIG. 7(*c*), the dimming information may not be able to be correctly acquired and a deficiency occurs in dimming control.

In order to solve such a deficiency, as shown in FIG. 9, the control section 24 of the dimming device 11 divides the period of each half cycle of the alternating-current voltage into a first section, a second section, and a third section on the basis of a synchronization signal generated by the synchronization-signal generating section 22. In the first section, the control section 24 subjects the switch section 19 to conduction control to supply electric power to the load L and subjects the converting action of the control power supply section 17 to stop control. In the second section, the control section 24 subjects the switch section 19 to non-conduction control to interrupt the power supply to the load L and subjects the converting action of the control power supply section 17 to the stop control. In the third section, the control section 24 subjects the switch section 19 to the non-conduction control to interrupt the power supply to the load L and subjects the converting action of the control power supply section 17 to operation control.

Specifically, if the microcomputer IC1 of the control section 24 discriminates the zero-cross of the alternating-current voltage on the basis of the synchronization signal from the synchronization-signal generating section 22, the microcomputer IC1 discriminates that the period is in the first section of the half cycle of the alternating-current voltage, subjects the switch section 19 to the conduction control through the switch drive section 20, and supplies the alternating-current voltage to the load L. In the first section, the microcomputer IC1 subjects the transistor Q10 of the control power supply section 17 to ON control and shifts to the sleep mode for halting functions other than necessary minimum functions including the timer function to suppress power consumption as much as possible. The microcomputer IC1 subjects the transistor Q10 of the control power supply section 17 to the ON control to stop the converting action for the control voltage. However, since charges accumulated in the electrolytic capacitor C18 are supplied to the microcomputer IC1, the microcomputer IC1 maintains the sleep mode.

The microcomputer IC1 determines that the period is switched from the first section to the second section after a predetermined time based on the zero-cross according to a set dimming level. The microcomputer IC1 temporarily returns from the sleep mode to a normal mode, subjects the switch section 19 to the non-conduction control through the switch drive section 20, and interrupts the power supply to the load L. The microcomputer IC1 that subjects the switch section 19 to the non-conduction control shifts to the sleep mode again. In the second section, as in the first section, the microcomputer IC1 subjects the transistor Q10 of the control power supply section 17 to the ON control to stop the converting action for the control voltage. However, since the charges accumulated in the electrolytic capacitor C18 are supplied to the microcomputer IC1, the microcomputer IC1 maintains the sleep mode. The capacity of the electrolytic capacitor C18 is set to a capacity for enabling maintenance of the functions of the microcomputer IC1 even if the control power supply section 17 is turned off in the first section and the second section.

In the second section, since the converting action of the control power supply section 17 is stopped, the electric current from the control power supply section 17 due to the relation between the control power supply section 17 and the bleeder circuit 48 does not flow to the power supply line. The waveform after the rectification phase-controlled by the dimming device 11 is a waveform in which the alternating-current voltage drops to zero during the period of each half cycle of the alternating-current voltage shown in FIG. 7(*b*). Therefore, the power supply circuit 42 of the load L can correctly acquire dimming information from a phase of the waveform in which the voltage drops shown in FIG. 7(*b*) and appropriately perform the dimming control.

The microcomputer IC1 determines that the period is switched from the second section to the third section after the predetermined time based on the zero-cross. The microcomputer IC1 returns from the sleep mode to the normal mode, subjects the transistor Q10 of the control power supply section 17 to the OFF control, and causes the control power supply section 17 to resume the converting action for the control power. Consequently, the control power is supplied from the control power supply section 17 to the microcomputer IC1 and the like and charges are accumulated in the electrolytic capacitor C18 of the control power supply section 17.

The microcomputer IC1 that returns to the normal mode can discriminate the next zero cross of the alternating-current voltage based on the synchronization signal from the synchronization-signal generating section 22. If the microcomputer IC1 discriminates the next zero-cross, the microcomputer IC1 completes the third section, discriminates that the period is in the first section in the next half cycle, and performs the control as explained above. The microcomputer IC1 sets the switch section 19 in the non-conduction state in the third section as well as in the second section.

In the third section, even if the control power supply section 17 performs the converting action and an electric current flows from the control power supply section 17 to the power supply line because of the influence of the control power supply section 17 and the bleeder circuit 48, since the power supply circuit 42 already acquires the dimming information, the dimming control by the power supply circuit 42 is not affected.

Since the microcomputer IC1 only has to be capable of receiving the supply of the control power, returning to the normal operation mode, and discriminating the next zero-cross, the third section may be a short period at timing immediately before the next zero-cross. By setting the third section short, it is possible to reduce a power loss in the control power supply section 17.

The impedance of the entire dimming device 11 is the lowest in the first section in which electric power is supplied to the load L, higher in the third section in which an electric current flows to the control power supply section 17 than in the first section, and the highest in the second section in which the power supply to the load L is stopped and the control power supply section 17 stops the converting action.

As explained above, in the first section, the dimming device 11 subjects the switch section 19 to the conduction control to supply electric power to the load L and subjects the converting action of the control power supply section 17 to the stop control. In the second section, the dimming device 11 subjects the switch section 19 to the non-conduction control to interrupt the power supply to the load L and subjects the converting action of the control power supply section 17 to the stop control to transmit dimming information to the load L side. In the third section, the dimming device 11 subjects the switch section 19 to the non-conduction control to interrupt the power supply to the load L and subjects the converting action of the control power supply 17 to the operation control to supply electric power to the control section 24 to enable the control section 24 to acquire a synchronization signal. Therefore, even if the load L includes the power supply circuit 42, it is possible to normally subject the load L to the dimming control.

The impedance of the entire dimming device 11 increases in the order of the first section, the third section, and the second section. Therefore, it is possible to simplify the circuit of the dimming device 11.

The control section 24 controls the switch section 19 and the control power supply section 17 in the order of the first section, the second section, and the third section during the period of each half cycle of the alternating-current voltage. Therefore, it is possible to cope with dimming control of an opposite phase control system.

Figure 10:
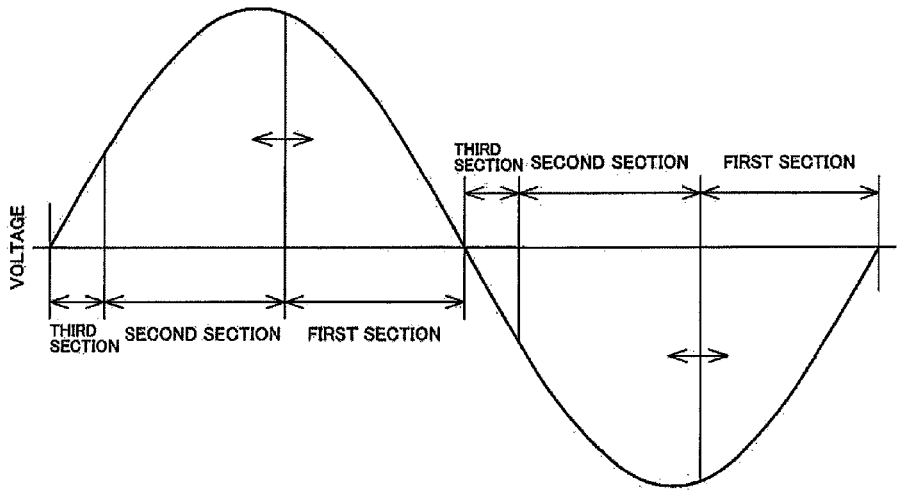
FIG. 10 is a waveform chart of a waveform of a voltage phase-controlled by a dimming device according to a second embodiment.

A second embodiment is shown in FIG. 10.

In the second embodiment, an example adapted to a phase control system for conducting to the load L halfway in a period of each half cycle of an alternating-current voltage according to a dimming level is explained.

The microcomputer IC1 of the control section 24 divides the period of each half cycle of the alternating-current voltage into a third section, a second section, and a first section in this order from the zero-cross.

If the microcomputer IC1 discriminates the zero-cross of the alternating-current voltage on the basis of a synchronization signal from the synchronization-signal generating section 22, the microcomputer IC1 discriminates that the period is in the third section of the half cycle of the alternating-current voltage. In the third section, the microcomputer IC1 subjects the transistor Q10 of the control power supply section 17 to the ON control and the control power supply section 17 performs a converting action for control voltage. Control power is supplied from the control power supply section 17 to the microcomputer IC1 and the like and charges are accumulated in the electrolytic capacitor C18 of the control power supply section 17. In the third section, the switch section 19 is set in a non-conduction state.

In the third section, even if the control power supply section 17 performs the converting action and an electric current flows from the control power supply section 17 to the power supply line because of the influence of the control power supply section 17 and the bleeder circuit 48, since the third section is a point of a small voltage at the rising edge of the half cycle and is a short period, the dimming control by the power supply circuit 42 is not affected.

The microcomputer IC1 determines that the period is switched from the third section to the second section after a predetermined time based on the zero-cross. The microcomputer IC1 subjects the transistor Q10 of the control power supply section 17 to the OFF control and shifts to the sleep mode for halting functions other than necessary minimum functions including the timer function to suppress power consumption as much as possible. The microcomputer IC1 subjects the transistor Q10 of the control power supply section 17 to the OFF control to stop the converting action for the control voltage. However, since the charges accumulated in the electrolytic capacitor C18 in the third section are supplied to the microcomputer IC1, the microcomputer IC1 maintains the sleep mode.

In the second section, since the converting action of the control power supply section 17 is stopped, the electric current from the control power supply section 17 due to the relation between the control power supply section 17 and the bleeder circuit 48 does not flow to the power supply line. The waveform after the rectification phase-controlled by the dimming device 11 is waveform in which the alternating-current voltage rises halfway in the period of each half cycle of the alternating-current voltage. Therefore, the power supply circuit 42 of the load L can correctly acquire dimming information from a phase of the waveform and appropriately perform the dimming control.

The microcomputer IC1 determines that the period is switched from the second section to the first section after the predetermined time based on the zero-cross according to a set dimming level. The microcomputer IC1 temporarily returns from the sleep mode to the normal mode, subjects the switch section 19 to the conduction control through the switch drive section 20, and supplies the alternating-current voltage to the load L. The microcomputer IC1 that subjects the switch section 19 to the conduction control shifts to the sleep mode again. In the first section, as in the second section, the microcomputer IC1 subjects the transistor Q10 of the control power supply section 17 to the OFF control to stop the converting action for the control voltage. However, since charges accumulated in the electrolytic capacitor C18 are supplied to the microcomputer IC1, the microcomputer IC1 maintains the sleep mode.

If the microcomputer IC1 discriminates the next zero-cross of the alternating-current voltage on the basis of the synchronization signal from the synchronization-signal generating section 22, the microcomputer IC1 completes the first section, discriminates that the period is in the third section in the next half cycle. The microcomputer IC1 returns from the sleep mode to the normal mode, subjects the switch section 19 to the non-conduction control through the switch drive section 20 to interrupt the power supply to the load L, and subjects the transistor Q10 of the control power supply section 17 to the ON control. Thereafter, the microcomputer IC1 performs the control as explained above.

As explained above, the microcomputer CI1 of the control section 24 controls the switch section 19 and the control power supply section 17 in the order of the third section, the second section, and the first section during the period of each half cycle of the alternating-current voltage. Therefore, it is possible to cope with dimming control of a phase control system.

The switch section 19 is not limited to perform the phase control at each half cycle using the two field effect transistors Q1 and Q2 and may perform the phase control at each half cycle using one switching element using a full-wave rectifier as well. The switch section 19 may use other switch configurations.

The load L may be either a bulb-type lamp or other luminaires including the power supply circuit 42. The light source is not limited to the LED elements 41 and may be other semiconductor light-emitting elements such as an EL element or may be a discharge lamp.

While certain embodiments have been described, these embodiments have been presented by way of example only, and are not intended to limit the scope of the inventions. Indeed, the novel embodiments described herein may be embodied in a variety of other forms; furthermore, various omissions, substitutions, and changes in the form of the embodiments described herein may be made without departing from the spirit of the inventions. The accompanying claims and their equivalents are intended to cover such forms or modifications as would fall within the scope and spirit of the inventions.

What is claimed is:

1. A dimming device comprising:

a switch section connected to an alternating-current power supply in series to a load and configured to phase-control an alternating-current voltage supplied to the load;

a synchronization-signal generating section configured to generate a synchronization signal synchronized with an alternating-current voltage waveform of the alternating-current power supply;

a control power supply section connected to the switch section in parallel and configured to convert the alternating-current power supply into predetermined control power and enable control of operation and stop of a converting action and include a capacitive element that accumulates the control power; and a control section configured to receive supply of the control power from the control power supply section through the capacitive element, divide, on the basis of the synchronization signal generated by the synchronization-signal generating section, a period of each half cycle of the alternating-current voltage into a first section, a second section, and a third section, in the first section, subject the switch section to conduction control to supply electric power to the load and subject the converting action of the control power supply section to stop control, in the second section, subject the switch section to non-conduction control to interrupt the power supply to the load and subject the converting action of the control power supply section to stop control, and in the third section, subject the switch section to the non-conduction control to interrupt the power supply to the load and subject the converting action of the control power supply section to operation control.

2. The device according to claim 1, wherein impedance of the entire dimming device increases in the order of the first section, the third section, and the second section.

3. The device according to claim 1, wherein the control section controls the switch section and the control power supply section in the order of the first section, the second section, and the third section during the period of each half cycle of the alternating-current voltage.

4. The device according to claim 1, wherein the control section controls the switch section and the control power supply section in the order of the third section, the second section, and the first section during the period of each half cycle of the alternating-current voltage.

5. The device according to claim 1, wherein the load includes an LED element and a power supply circuit configured to turn on the LED element.

6. A lighting system in which a load and a dimming device are connected to an alternating power supply in series, the dimming device including:

a switch section connected to an alternating-current power supply in series to a load and configured to phase-control an alternating-current voltage supplied to the load;

a synchronization-signal generating section configured to generate a synchronization signal synchronized with an alternating-current voltage waveform of the alternating-current power supply;

a control power supply section connected to the switch section in parallel and configured to convert the alternating-current power supply into predetermined control power and enable control of operation and stop of a converting action and include a capacitive element that accumulates the control power; and a control section configured to receive supply of the control power from the control power supply section through the capacitive element, divide, on the basis of the synchronization signal generated by the synchronization-signal generating section, a period of each half cycle of the alternating-current voltage into a first section, a second section, and a third section, in the first section, subject the switch section to conduction control to supply electric power to the load and subject the converting action of the control power supply section to stop control, in the second section, subject the switch section to non-conduction control to interrupt the power supply to the load and subject the converting action of the control power supply section to stop control, and in the third section, subject the switch section to the non-conduction control to interrupt the power supply to the load and subject the converting action of the control power supply to operation control.

7. The system according to claim 6, wherein impedance of the entire dimming device increases in the order of the first section, the third section, and the second section.

8. The system according to claim 6, wherein the control section controls the switch section and the control power supply section in the order of the first section, the second section, and the third section during the period of each half cycle of the alternating-current voltage.

9. The system according to claim 6, wherein the control section controls the switch section and the control power supply section in the order of the third section, the second section, and the first section during the period of each half cycle of the alternating-current voltage.

10. The system according to claim 6, wherein the load includes an LED element and a power supply circuit configured to turn on the LED element.

* * * * *